US006402486B1

(12) United States Patent
Steck et al.

(10) Patent No.: US 6,402,486 B1
(45) Date of Patent: Jun. 11, 2002

(54) FREE-DIAPHRAGM PUMP

(75) Inventors: Ricky B. Steck, West Jordan; Michael R. Dunn, Sandy; Troy Orr, Draper; Matthew J. Stillings, Sandy; David Kingsbury, West Jordan, all of UT (US)

(73) Assignee: Trebor International, Inc., West Jordan, UT (US)

( * ) Notice: Subject to any disclaimer, the term of this patent is extended or adjusted under 35 U.S.C. 154(b) by 0 days.

(21) Appl. No.: 09/946,752

(22) Filed: Sep. 4, 2001

Related U.S. Application Data

(63) Continuation of application No. 09/642,426, filed on Aug. 21, 2000, now abandoned, which is a continuation of application No. 09/166,490, filed on Oct. 5, 1998, now Pat. No. 6,106,246.

(51) Int. Cl.[7] ..... F04B 43/06; F04B 49/00

(52) U.S. Cl. ..... 417/395; 417/63; 418/2

(58) Field of Search ..... 417/46, 63, 375, 417/393, 394, 395, 474, 360, 405; 92/98 R, 99, 100, 102, 103.5; 418/2, 45; 73/168; 385/12; 356/477, 478, 901

(56) References Cited

U.S. PATENT DOCUMENTS

| | | | | | |
|---|---|---|---|---|---|
| 4,722,752 | A | | 2/1988 | Steck | 134/25.4 |
| 4,787,825 | A | | 11/1988 | Mantell | 417/395 |
| 4,854,832 | A | | 8/1989 | Gardner et al. | 417/395 |
| 4,902,350 | A | | 2/1990 | Steck | 134/1 |
| 4,904,167 | A | | 2/1990 | Eickmann | 417/395 |
| 4,981,418 | A | * | 1/1991 | Kingsford et al. | 417/63 |
| 5,062,770 | A | | 11/1991 | Story et al. | 417/375 |
| 5,261,798 | A | | 11/1993 | Budde | 417/393 |
| 5,263,827 | A | | 11/1993 | Esposito et al. | 417/395 |
| 5,326,234 | A | | 7/1994 | Versaw et al. | 417/393 |
| 5,362,212 | A | | 11/1994 | Bowen et al. | 417/395 |
| 5,409,355 | A | | 4/1995 | Brooke | 417/395 |
| 5,466,133 | A | * | 11/1995 | Tuck, Jr. | 418/2 |
| 5,520,523 | A | | 5/1996 | Yorita et al. | 417/387 |
| 5,527,160 | A | | 6/1996 | Kozumplik, Jr. et al. | 417/46 |
| 5,540,568 | A | | 7/1996 | Rosen et al. | 417/395 |
| 5,564,911 | A | | 10/1996 | Santa | 417/395 |
| 5,567,118 | A | | 10/1996 | Grgurich et al. | 417/393 |
| 5,649,813 | A | | 7/1997 | Able et al. | 417/393 |
| 5,816,778 | A | | 10/1998 | Elsey, Jr. et al. | 417/395 |
| 5,860,794 | A | | 1/1999 | Hand et al. | 417/395 |
| 6,106,246 | A | | 8/2000 | Steck et al. | 417/395 |
| 6,142,749 | A | | 11/2000 | Jack et al. | 417/395 |
| 6,152,704 | A | * | 11/2000 | Aboul-Hosn et al. | 417/360 |
| 6,168,394 | B1 | | 1/2001 | Forman et al. | 417/393 |

OTHER PUBLICATIONS

ALMATEC Maschinenbau GmbH, "Almatec One 4 All . . ." (advertisement).

ALMATEC Maschinenbau GmbH, "Corporate Profile" (advertisement).

(List continued on next page.)

*Primary Examiner*—Willis R. Wolfe
(74) *Attorney, Agent, or Firm*—Workman, Nydegger & Seeley

(57) ABSTRACT

A pump for ultra-pure fluids comprises a flexible diaphragm separating a fluid chamber from an air chamber. The diaphragm creates an airtight seal between the fluid chamber and the air chamber when a self-centering and trapezoidal shaped wedge compressively forces the diaphragm into a trapezoidal shaped perimeter cavity surrounding the chambers. Any leak from the fluid chamber into the air chamber is detected by a fiber optic system comprising two optical fibers that are disposed at an angle that is calculated to enable light to pass between the fibers only in the presence of a liquid having a predetermined index of refraction. The fiber optic system can also be used to determine the stroke of the pump by disposing the fiber optic lines at an angle calculated to reflect light off of the oscillating diaphragm when the diaphragm arrives at a predetermined location.

24 Claims, 10 Drawing Sheets

OTHER PUBLICATIONS

ALMATEC Maschinenbau GmbH, "Technical Data Sheet" (advertisement).
ASTI Corp. USA, "Controlled Flow Teflon Pump" (advertisement). Oct. 1997.
"F Series: The world's leading pneumatic drive bellows pumps." No Date Given.
Nippon Pillar Packing Co., Ltd., "Circulation System For Medium Temp" (advertisement). No Date Given.
White Knight Pumps & Fittings, Inc. "Corporate Profile" (advertisement). No Date Given.
White Knight. "White Knight: It just makes sense." (advertisement). Mar. 1996.
Wilden, "The Wilden Pump—How It Works" (advertisement), No Date Given.
Wilden, *Chemical Pumping Solutions (brochure)*, Jan. 1997.
Yamada, "Double Diaphragm Pump F Series" (advertisement), Feb. 1985.

* cited by examiner

FREE-DIAPHRAGM PUMP

CROSS-REFERENCE TO RELATED APPLICATIONS

This application is a continuation of U.S. patent application Ser. No. 09/642,426, entitled FREE-DIAPHRAGM PUMP, filed Aug. 21, 2000, abandoned, which is a continuation of U.S. patent application Ser. No. 09/166,490, entitled FREE-DIAPHRAGM PUMP, filed Oct. 5, 1998, which has issued as U.S. Pat. No. 6,106,246. Each of the aforementioned applications is incorporated herein by reference.

BACKGROUND OF THE INVENTION

1. The Field of the Invention

This invention relates to components for operation in ultra-pure environments and, more particularly, to novel systems and methods for providing long-lived pumps that are metal-free, ultra-pure, non-reactive, etc. for providing environments for hot, reactive or pure, liquids at elevated temperatures, with respect to ambient.

2. The Relevant Technology

Non-reactivity is a critical function in systems managing, transporting, or relying upon fluids. Fluids include gases and liquids. Many industrial processes rely on liquids, that may damage, weaken, leach, or otherwise interact with metals, elastomeric polymers, and other common materials.

One industry that has suffered with the limited technology available to provide high purity and temperature is the semiconductor processing industry. For example, hot, de-ionized water is used in numerous processes. Impurities are measured in parts per billion. Some materials may be hot acids used in etching and cleaning processes. Transporting, holding, heating, and other procedures for managing ultra-pure water, acids, and the like, are problematic in several ways.

For example, pumps have traditionally been made of metal. Metals are commonly used in the support structures of the pumps. Regardless of the "stainlessness" of a metal, the purity requirements are not met by any known metals.

Polymers are often used for sealing members but may leach, react, degrade, or otherwise contaminate liquids. Moreover, polymers are typically not dimensionally stable. Polymers creep, stretch, yield, and otherwise become unreliable. Polymers (plastics, elastomers) respond to load, pressure, time, chemical environment, and, if any system failure occurs, may destroy any hope of reliability and "failing clean," failing to function yet leaving no contamination possible. Failures in the sealings may arise by creep or yielding of polymers. Leaks or other failures may expose materials during any failure. Accordingly, seals do not achieve perfect protection. The ability to avoid failures completely ranges from extremely difficult to impossible. Failures can be catastrophic if a system will not "fail clean."

Contaminants in trace amounts which exceed allowable limits may destroy a batch of product. Physical destruction is not required. Rendering a silicon wafer, or other high purity substrate material, unusable due to contaminant reaction with a surface can waste product output. Down time for decontamination may be even more costly in actual lost production.

What is needed is a fluid handling system that is clean to extremely high standards. All materials that may potentially contact contained fluids, even in the event of failures, should be pure and non-reactive. Materials should tolerate temperatures in the range of 1 degree Celsius to 180 degrees Celsius.

In some acids, temperatures may range from 100 degrees Celsius to 180 degrees Celsius.

Thus, stability over a broad range of temperatures, reliability in service, long life under exposure to extreme of temperatures, pressure, and reactive agents, and the like must all be tolerated. Repeatability of designs, and reliable repeatability over the lifetime of all installed apparatus in the system are very desirable. Currently, the most reliable pump mechanisms still depend on elastomeric seals and metal structural supports. Pumps do not have sufficient life and do not "fail clean" in service. Upon failure, metals and elastomers are then exposed and are reactive. Thus, pumps still fail to maintain purity in failure or to operate reliably over many millions of cycles.

What is needed is a reliable, failclean, pump that operates over 10–50 million cycles, and that maintains purity, even in failure. Long term durability at elevated temperatures, pressures, and reactivities, without the threat of catastrophe at failure, is needed.

BRIEF SUMMARY OF THE INVENTION

In view of the foregoing, it is a primary object of the present invention to provide a clean, high temperature, non-reactive, repeatable, producible, reproducible, low-cost, dimensionally stable, long-lived pump.

It is an object of the invention to provide a pump that will tolerate conventional manufacturing processes while providing suitable reliability and low-cost operation and maintenance for routine installations.

It is an object of the invention to provide a pump construction that can rely on readily available materials and readily available manufacturing processes at standard a manufacturing tolerances in order to maintain costs while providing reliability over tens of millions of cycles.

It is an object of the invention to provide reliable sealing in a pump, long-lived diaphragms at low cost, and a simple reliable mounting assembly that will support a fluid handling system and which will fail clean in the event of any failure.

Consistent with the foregoing objects, and in accordance with the invention as embodied and broadly described herein, an apparatus and method are disclosed, in suitable detail to enable one of ordinary skill in the art to make and use the invention. In certain embodiments an apparatus and method in accordance with the present invention may include a body and heads holding diaphragms with an associated adaptive seal. A union ring on each head may be provided, to connect to the body and to hold the diaphragm securely.

A pump may be assembled with threads. A union-type connector may hold the body and a head together. In one apparatus and method in accordance with the invention, a polymeric, preferably a fluoropolymer and non-reactive film, may form a diaphragm. The diaphragm maintains a single, substantially constant thickness without the need for changes in cross-section in order to accommodate mounting. The diaphragm may be contoured to fit a chamber so as to match the chamber wall at each end of a stroke. Accordingly, the diaphragm is fully supported when the pump is dead-headed, or backed up in a flooded or shut off position.

As a practical matter, no inflection point is required in the diaphragm during any unconstrained or unattatched point of its traverse. Hardware contact on the diaphragm is not substantial enough to cause overstressing, secondary creep, yielding or the like in the diaphragm.

The diaphragm is extremely reliable such that it becomes non-limiting in the life of the pump. Components close to the diaphragm use tight tolerances, closely matched angles, and short gaps between components. The configuration of the components provides for little unsupported material which reduces the stress within the material. No other loading is applied to the diaphragm. In the event of an air system failure, in an air-actuated pump, the high pressure applied to the diaphragm will be supported by the backing material on a chamber head or piston head. Likewise, since no buckling is required in the diaphragm, there is no change of direction and no inflection point within the chamber during operation. As a result, the life of the pump is greatly extended.

In one embodiment, the frame may be installed using a trapezoidal seal shim that produces a sharp angle bend, preferably less than or equal to 70 degrees. Thus, the diaphragms may be locked into trapezoidal slots, and held in place by trapezoidal shims, all comprising the same class of material, and preferably the exact chemically consistence or chemically identical material. Accordingly, the pump diaphragms limit any need for rim or compression seals, clamps, flanges, elastomeric seals, metals, and the like.

In one embodiment, the trapezoid may be irregular. One side may have a 70 degree angle, 20 degrees less than a right angle, and the other side may be a right angle. In another embodiment the trapezoid is regular and has a 70 degree angle, 20 degrees away from normal or perpendicular. The seal formed in a regular trapezoid becomes self centering.

The diaphragm is retained using no elastomeric materials, no rims, no metals, no flanges, no through-holes, and the like. Furthermore, the diaphragm is subjected to equalized loads. Prior art systems dealing with elastomeric materials will not fail clean. Moreover, creep is a factor in all fluoropolymers. However, geometries that can creep are adapted to conform to the seal, forming a tight mechanically adhesive load between the shim, the diaphragm, and the receiver slot for the shim.

A design after this mode prevents creation of diaphragm flange material that would pull in and increase diaphragm arc length. Increasing the diaphragm arc length tends to cause buckling or diaphragm roll at the point of flexure or the point of maximum flexure near the outer most confines of the chamber in which the diaphragm is located. Thus, even thin films of less than or equal to 30 thousands inch may be operated without buckling. Therefore, folding of the diaphragm and premature rupture of the diaphragm is avoided.

In one embodiment, a union nut is used to secure the head of the pump to the pump body or pump frame. A union nut is a slip ring having an aperture allowing the head to protrude there through away from the pump frame or pump body. The head may thus be registered, and the nut is fully free to slip circumferentially while loading the head longitudinally along the access of the driving rod between the pistons and diaphragms of the pump.

A non-reactive material, preferably a polypropylene is used to construct the entire nut. The nut applies a load to a cantilevered edge or lip of the head. Accordingly, primary creep is allowed to occur and loaded out. Thereafter, the head maintains sufficient spring properties, along with sufficient deflection under such spring properties, to maintain the minimum required loading of the head against the pump body at all times of service.

Moreover, the creep losses of thread materials and of the cantilevered head combine to permit less deflection than that required to maintain the spring loads in spite of continuing secondary creep. Therefore, head loading is maintained. The seal surface remains loaded and sealing. Pneumatic loading on the heads during actuation of the pump diaphragms is ineffective to cause excessive creep and unload the heads. Moreover, weeping, releasing chemicals, is eliminated. Moreover, compliant elastomeric seals are not required to act as energizers. Again, such a sealing system provides for a "fail-clean" failure in the event of any potential failure.

In one embodiment, the heads of the pump may be provided with leak detectors. The leak detectors may be sealed away from the fluid of the pump by a window. The window is constructed of "non-reactive" material that allows light to transmit.

In one embodiment, a thin diaphragm may be formed of polytetrafluoretheyne. In one embodiment, an anisotropic polymer is used. Moreover, in one embodiment, an expanded PTFE may be used.

Other plastics such as PFA may be used. Nevertheless, PTFE has been shown to be most effective. Moreover, by forming the diaphragm of PTFE, an amorphous fluoropolymer, a flexible diaphragm making a mechanically hermetic seal with the pump body and head (trapezoidal slot and shim) is so effective in practice that in certain circumstances minimal to no loading of the seal is required after a certain period of operational time.

Creep is ever present with fluoropolymers. Accordingly, threads creeping is typical when in tension and shrinking when in compression. Creep and shrinking presents a continuing problem in the use of fluorocarbons. In one embodiment, an entire pump may be assembled, with the lip on the edge of a head retained in an engagement portion of a slip ring or union nut threaded to the body of the pump.

Accordingly, creep will ensue in all components, the body, the cantilevered head portion and the slip ring or union nut. However, heat soaking and below ambient cooling under load may remove primary creep. Thereafter, the nut or union nut may be retightened on each end of the pump, maintaining dimensions within tolerances required for loading. Thus, secondary creep occurring after a heat soak and cooling cycle and loading of primary creep, is insufficient to unload the cantilevered member of the head, and thus maintains the head against the body in sealing relation.

A pump made in accordance with the invention improves operations substantially by including no metallic parts and no elastomeric parts. That is, an apparatus in accordance with the invention, is intended to "fail clean." To fail clean signifies that a failure of any component within the pump, including any sealing component, results in no contamination of any liquids by reactive materials. Reactive materials include elastomeric polymers such as Neoprene™, Viton™, Nitrile, FKM, EPDM and the like. Other reactive materials include virtually all metals. Although some metals are considered non reactive, the requirements for the purity of liquids used in the semi-conductor processing industry is so strict that even "nonreactive" metals must be considered reactive in so far that the invention is concerned.

Thus, valves in the apparatus made in accordance with the invention contain no reactive components. Two types of strike valves or end-of-stroke valves are contemplated. In one embodiment, a short-stroke valve or poppet valve may operate at the end of a stroke of a diaphragm. The diaphragm, upon reaching the limits of the displacement permitted by a head portion of the operating cavity, contacts the head dome or cavity. Accordingly, a protrusion or post on a poppet valve is contacted by the diaphragm. The poppet valve opens a channel (air channel) to communicate with the now-evacuated head chamber over the diaphragm. The poppet valve, it's actuator with a post integrally formed therewith, and a seat securable, such as threadable, to the head, may be provided.

In another embodiment, a long valve may be adapted to access the end of a stroke of a diaphragm or piston retreating away from the head and toward the body of a pump in accordance with the invention. A long-stroke, pilot valve may be designed to operate as a spool. Accordingly, a shank or shaft of the long-valve may be provided with a bumper maintained in contact with a diaphragm, such as against a diaphragm over an underlying piston head driving and being driven by the diaphragm.

The spool shaft, shank, tang, etc. thus extends into the chamber until the piston and diaphragm are halted by stops. Thereafter, chamber pressure may bleed through ports in the pilot valve to shift operation of the pump, by reversing the stroke. The spools may be designed as known in the art to use the main shaft, having a circumferentially extending channel, with cylindrical bearings passing over ports. Accordingly, bearings may selectively expose ports to circumferential channels, thus altering a position of the spool and subsequent channeling of flows between ports in a main housing surrounding the spool.

In one embodiment, only machined surfaces of nonreactive materials act as sealing surfaces. Additional wear may occur due to a lack of hardness, durability, abrasive-resistance, and the like. Nevertheless, nonreactive polymers maintain low core frictions with one another in certain embodiments. Moreover, any particulates from galling, wear, abrasion, fretting, and the like will nevertheless remain nonreactive. Accordingly, filters and traps within flow lines may typically remove such particulates, and the presence of such particulates will not cause leaching of contaminating ions into pumped fluids.

In one embodiment, no elastomeric seals are used in any valve, including principal check valves checking against back flows into the double chambers of the pump. Machined surfaces serve as sealing surfaces, and relief or clearance is provided in each circumstance where needed in order to maintain loads, tolerate secondary creep, following heat soaking primary creep out, such that loading and deflection requirements for sealing are maintained.

Metal springs are used in certain devices. Likewise, elastomeric seals, such as face seals or "O" rings and the like are often used in prior art systems to form seals. Downtime, lost processing batches, and the like are very expensive propositions. Accordingly, a fail clean system made in accordance with the invention relies on no metal springs, no metal washers, no metal retainers, and no metal of any kind. The fail clean system further does not rely on reactive, or organic materials exposed to operating fluids (gases, air) nor the transferred fluids (DI water, acids, hot acids, etc.). Any possible contact between the air chamber, or the liquid chamber in the pump (of which the pump has two of each, typically) eliminates all contact even in the air chamber with metals and elastomers.

In one embodiment of an apparatus and method in accordance with the invention, a base mounting system may be used for integrating a controller with a pump. Air controllers may be external and may be remote from a pump. However, mounting a pump is often problematic. Accordingly, a base is provided in which fluid conduits of the pump are formed to become the legs connecting a pump for mechanical support to a base. Meanwhile, the entire air controller mechanism may be formed in the base. Alternatively, the base may simply pass air through the pump from an external controller, depending on a users selection.

Several types of air control systems exist. A recirculating air system does not use high pressure. A high duty cycle is typical. Duty cycles bordering on 100 percent over many days may exist. Such a recirculating control system may operate non-stop indefinitely. An external control apparatus relies on a third party to connect a speed control to a pump installation. The third-party speed control dictates the amount of air flow to actuate a pump. Accordingly, reducing volume or pressure of incoming, driving air can be used to decrease the speed of operation of the pump. Thus, decreased displacement may be obtained directly by an external control.

A third type of control module may be a distribution unit. A distribution unit may operate under control of controlling mechanisms within the base. However, as a distribution unit, a pump in accordance with the invention may be dead-headed against a closed line. Thus, the entire pressure of the pump may be brought to bare against the pump and conduit system. A modular air pump may be made externally removable. However, a mount in accordance with the invention may be used for either recirculating air, external air vented to atmosphere after actuation of a cycle of the pump operation, or a distribution unit in which air is recirculated but the pump may be dead-headed against a closed line. A mount may provide a platform adapted to a universal pump. Adapted to different bases for control schemes.

By providing the opportunity for an external air system to mount to the base, the air logic transfer passages may be connected to the pump body directly from the external control system without the use of elastomeric seals. The base is symmetric about its air logic porting. One may note that externally controlled systems theoretically produce no contaminates that could be received into a system. Nevertheless, the pump in accordance with the invention is provided with rapid discharge of all controlling air overboard.

The air logic system is isolated, on the one hand, from the pump, on the other hand, the air logic and air connection system is easily removable and serviceable. Moreover, a clamping block may be inserted laterally into the base, to be locked against the base, maintaining the pump in position. The logic and connection system are easily serviceable in such a package, especially when provided with quick-release capability. Likewise, fluid systems need not be opened in order to conduct air system repairs or service. Since the material in the lines and the pump chambers for liquid is ultra pure, elimination of any possible contact of elastomers, metals, or the like.

A spool valve actuated by a pilot valve detecting the end of a stroke of a diaphragm may be implemented to control the speed and the return of a piston driving or being driven by a diaphragm. However, spool valves may be somewhat treacherous. Spool valves typically receive a signal from one line, and they try to equilibrate that signal at some point. For example, at the end of a stroke, the pilot valve cannot move, and air ported through the pilot valve accumulates in a location. As the pressure in a specific location rises, it may act in an axial direction (transversely with respect to an axis of the driving shaft on the pistons) to shift the position of the spool or shuttle. Stabilizing shifting pressure at a specific location has traditionally been difficult.

A detent or bias mechanism may be implemented in accordance with the invention. Previous diaphragms have typically been frameloaded. For example, in flange-mounted diaphragms, a widely varying range of pressures results in shifting a spool or shuttle. Overcoming friction and the like may provide unreliable forces. In an apparatus and method in accordance with the invention, a snap disk is positioned to a collar and shaft of a spool. A disk is maintained in a cavity restricting the diameter thereof. Nevertheless, longitudinally, with respect to the shuttle or spool, the detent is free to move.

The detent is free to move axially, with respect to the spool or shuttle within a gap freely. However, the detent must break over a center in order to change position between a first biased position deflected in a first direction and a second biased position deflected in a second opposite direction axially with respect to the spool. Moreover, the detent may be made of a particularly stiff material rather than a softer, more flexible elastomeric material. The effect of the more rigid, stiff, radially-constrained, axially-free bias detent is to provide a strict, digital motion of the spool at a narrowly repeatable pressure change.

In keeping with a virtually absolute prohibition against a metallic or otherwise reactive materials in the air path and the liquid path of a pump in accordance with the invention, a rapid exhaust valve is provided. Again, rather than common elastomeric materials, a thin, comparatively rigid, stiff film is provided. A disk of the film may be on the order of less than 0.010 inches in thickness. The dump valve or quick exhaust valve is included to divert rather than return controlled air.

For example, a circulating air control is returned to a prime mover. However, external control systems use ambient air, that is discharged after one use. Thus, a plastic disk is provided that deflects to permit passage of air around it's exterior perimeter and yet to close down against a port at near the center thereof and on the opposite side thereof in response to an airflow in the opposite direction. Thus, a very rapid dump around the exterior parameter of the disk may be conducted, yet no back flow into the lines can occur at any significant rate or total amount.

In one embodiment, a chamber holds the disk. The disk is supported on a grid on one side with fluted walls providing a standoff distance between the outer most radius of the disk and the outer most radius of the containing chamber. Accordingly, air may pass around the disk. The disk is mounted to press against a face of a port occupying an area very near the center of the disk on one side. During venting, air may pass out of the port against the disk, deflecting the disk and passing around the outermost circumference of the disk. By contrast, any pressure of air against the disk from an opposite side nearly forces the entire disk back against the port, sealing the port off against backflow.

A leak detection scheme may rely on fiber optics. In one embodiment, the leak detectors may include a body containing fiber optic lines disposed at an angle calculated to produce reflection of a beam from one fiber optic line to a receiving, second, fiber optic line, only in the presence of liquids. The difference in refractive indices of air and liquids common to processing in the semiconductor industry is sufficient to detect the presence of liquids in the air chamber actuating the piston.

In one embodiment, the fiber optic lines may be sealed against liquids for direct contact with the chamber of the pump. In another embodiment, a separate window may be provided having a very thin thickness, and formed of a material that is likewise non-metallic, high purity, non-electrical, nonreactive, and sealed. In such an embodiment, an acrylic fiber may be used. Acrylic fibers will absorb more deflection during handling.

By contrast, fiber optics may tend to break when mishandled, such as by being bent on too tight a radius. It is important to protect operators from being sprayed by exhaust or by controller exhaust when an external controller is used to operate a pump in accordance with the invention. In such an environment, a chamber filled with fluid, may be evacuated by the continuing operation of an external controller, unresponsive to the leak. In one presently preferred embodiment, a window completely seals the chamber from the leak detector, as an acrylic, fiber optic line may be used.

The double-line design is superior to prior art systems and other technologies wherein fiber optic lines are laid side-by-side in order to cooperatively send and receive a beam. The difficulty with such embodiments often includes an inability to define a digital location at which reflected light intensity indicates either a liquid is present or that an end of stroke of the pump has been reached. By using off-axis orientations between the sending and receiving fibers, the index of refraction or the presence of a film layer creates a dramatic, even digital demarcation between a desired condition and an undesired condition.

In one embodiment, a leak detector may be located near an outer circumference of a chamber in which a diaphragm is operating. In such an embodiment, another leak detector may be positioned centrally or elsewhere within an air chamber in order to identify an end of a stroke by the pump. Accordingly, an external controller may use a fiber optic detector for the end of the stroke of the diaphragm of the pump.

For example, as in parallel lines that become retroreflective, a pre-determined angle may be established between two, separate, cooperative fiber optic lines. The difficulty of establishing a value or trigger lever for the reflected light from a sending fiber to a receiving fiber is eliminated by the construction in accordance with the invention. Rather, the range of distance within which a diaphragm positioned to reflect light from the sending fiber to the receiving fiber may be adjusted within a very narrow range. The narrowness of the range is sufficiently precise to be effective for operational functionality of the pump.

The signal corresponding to the reflection of light quickly decays to a minimal value far from that corresponding to a trigger position. Whenever the diaphragm moves away from a specific location designed for the sensor. Thus, a detector in accordance with the invention provides a digital signal rather than an analog signal, for all practical purposes with respect to detecting the end of stroke for controlling the operation of the pump.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

It will be readily understood that the components of the present invention, as generally described and illustrated in Figures herein, could be arranged and designed in a wide variety of different configurations. Thus, the following more detailed description of the embodiments of the system and method of the present invention, as represented in FIGS. 1 through 11, is not intended to limit the scope of the invention. The scope of the invention is as broad as claimed herein. The illustrations are merely representative of certain, presently preferred embodiments of the invention. Those embodiments will be best understood by reference to the drawings, wherein like parts are designated by like numerals throughout.

Figure 1:
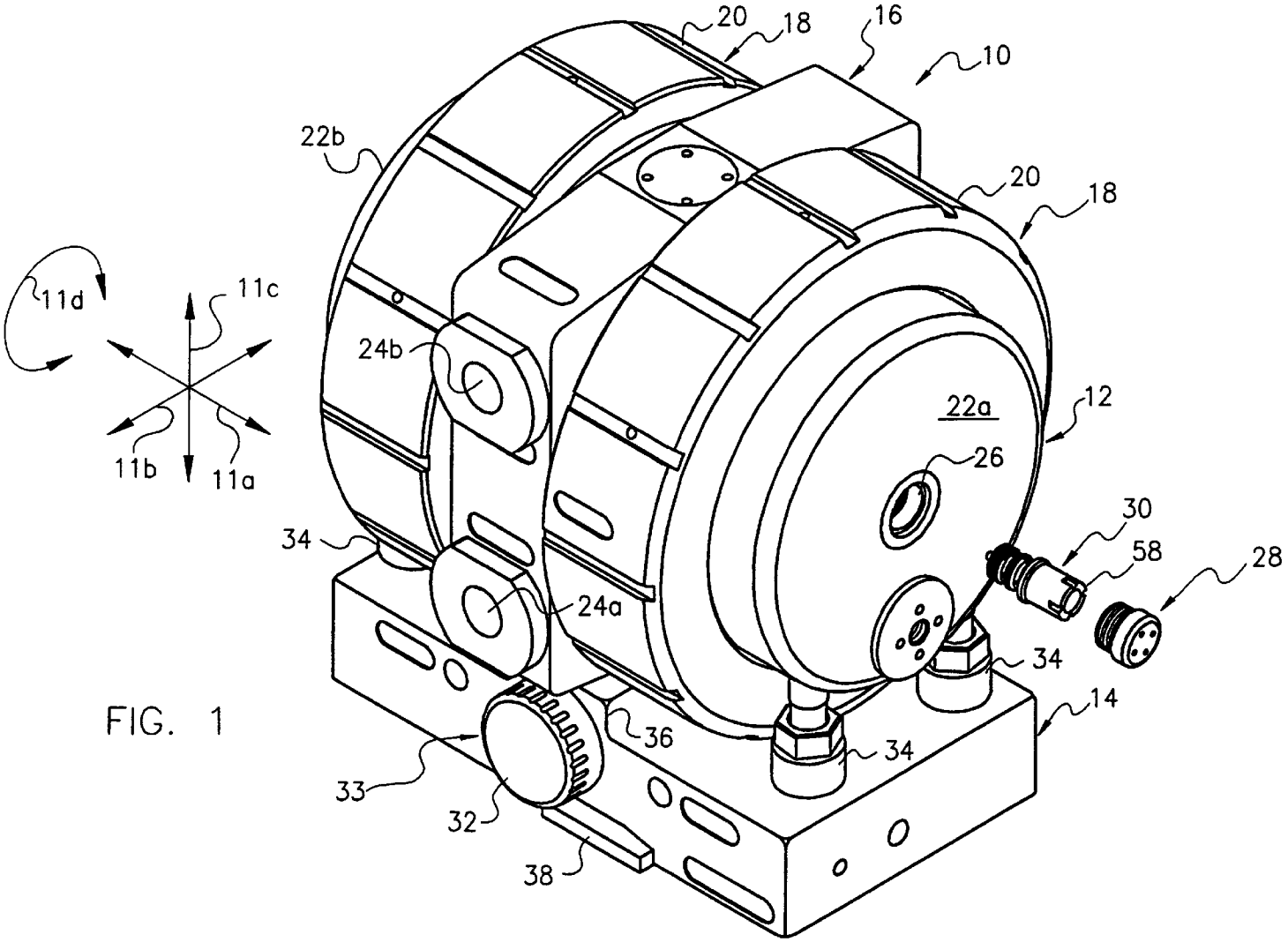
FIG. 1 is a front quarter perspective view of a pump in accordance with the invention.

Referring to FIG. 1, an apparatus 10 for pumping a transfer fluid such as hot, de-ionized water, etching acids, or the like may be formed of components manufactured of exclusively of nonreactive, non-contaminating materials. In one embodiment, an apparatus 10 may be oriented to have a longitudinal direction 11*a*, a lateral direction 11*b*, a transverse direction 11*c*, and a circumferential direction 11*d*. The apparatus 10 comprises a pump 12 and a supporting apparatus 14, such as a controller 14 or base 14. In one embodiment, the controller 14 and base 14 may be integrated into a single component. As a practical matter, a controller 14 may be separate, distinct, remote, and external with respect to a pump 12. Also, a base 14 may be manufactured to attach securely to a body 16 of a pump 12. However, in one presently preferred embodiment, the pump 12 is integrated into a controller/base 14 all integrated into a monolithic unit. Thus, installation, control, integrity, valving, porting, fluid communications, and the like may be factory-integrated for an improved reliability. Moreover, contamination may be reduced, and the opportunities to damage or alter equipment upon installation are reduced. Moreover, the sealing technologies appropriate for operating with such nonreactive materials as fluoroplastics, creep-prone materials, may be implemented in the manufacturing assembly of the entire apparatus 10 as a pump 12 and controller/base 14 with accompanying interconnection.

The body 16 of the pump 12 may be referred to also as a frame. In one embodiment of an apparatus 10 in accordance with the invention, the body 16 replaces external frames, through-bolts, metallic connections, and the like. As a result, the apparatus 10 results in a very compact envelope having the features of reliable design, creep-insensitivity, durability, extremely long life, fail clean operation, and completely sealed fluid paths. The life of the apparatus 10 may exceed 10 million cycles. As a practical matter, units may be designed to exceed 20 million cycles, 30 million cycles, 40 million cycles, 50 million cycles, and 100 million cycles of the pump with no operational failure of any component. This is particularly important with respect to moveable components within the apparatus 10.

Figure 2:
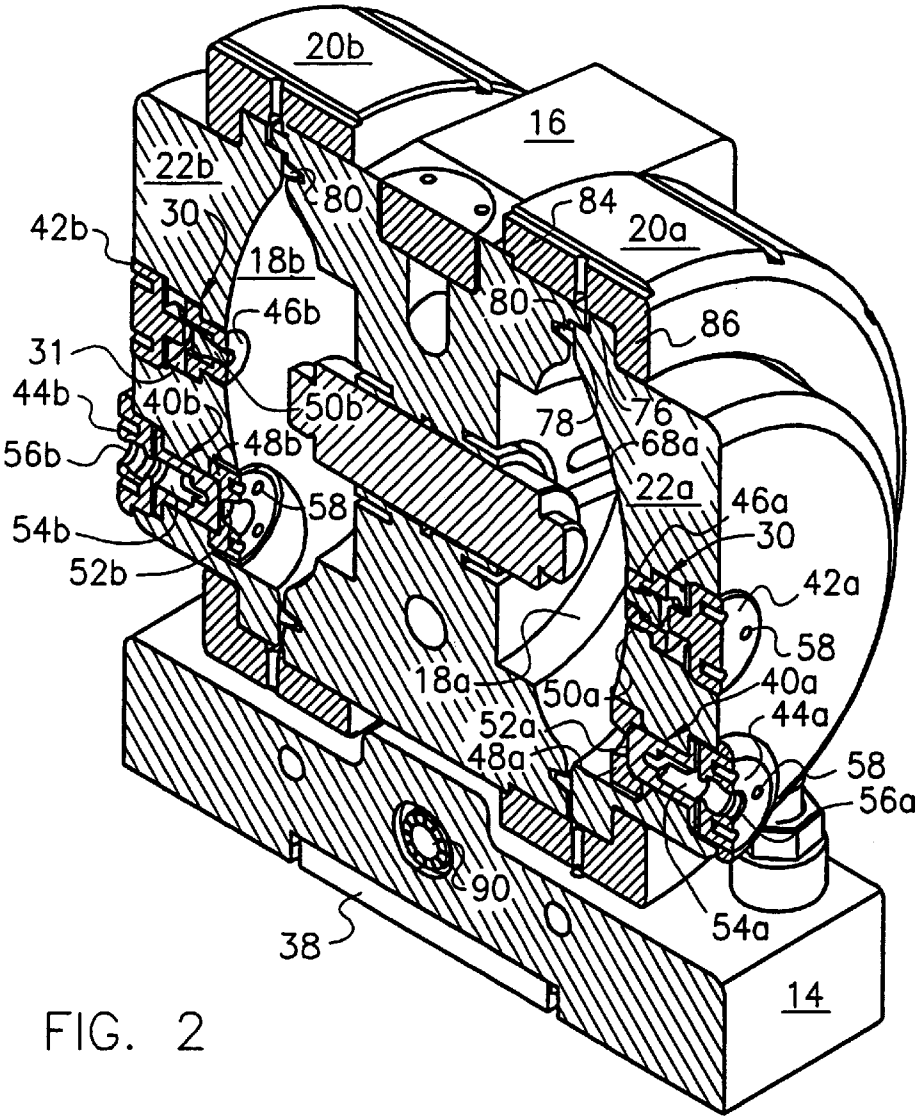
FIG. 2 is a sectioned, perspective view of one embodiment of a pump in accordance with the invention.

The pump 10 may be configured to contain two chambers 18. With reference to FIG. 2, the chambers 18*a*, 18*b*, are shown. The chambers 18*a*, 18*b* are simply specific instances of a generic chamber 18. Hereinafter, trailing alphabetical references refer to specific instances of those items to which leading reference numerals refer.

Figure 3:
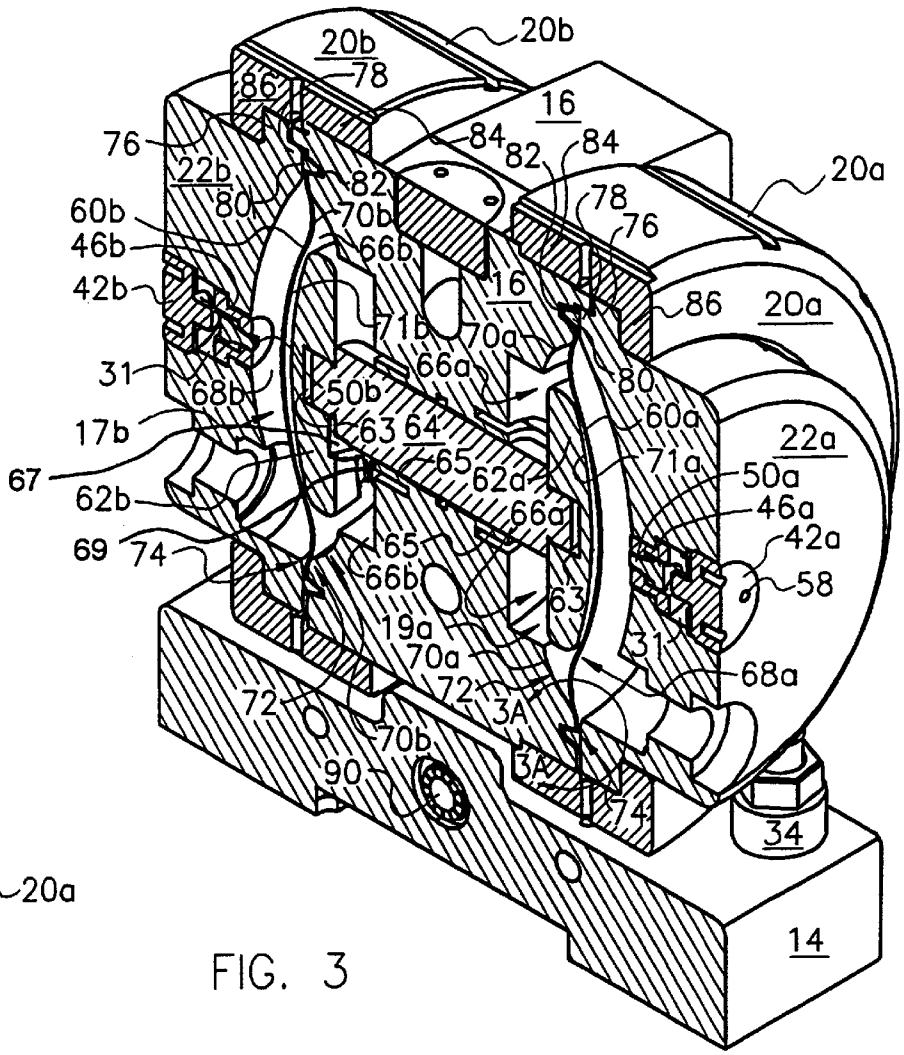
FIG. 3A is a sectioned, side, view of a portion of the pump illustrated in FIG. 3.
Figure 4:
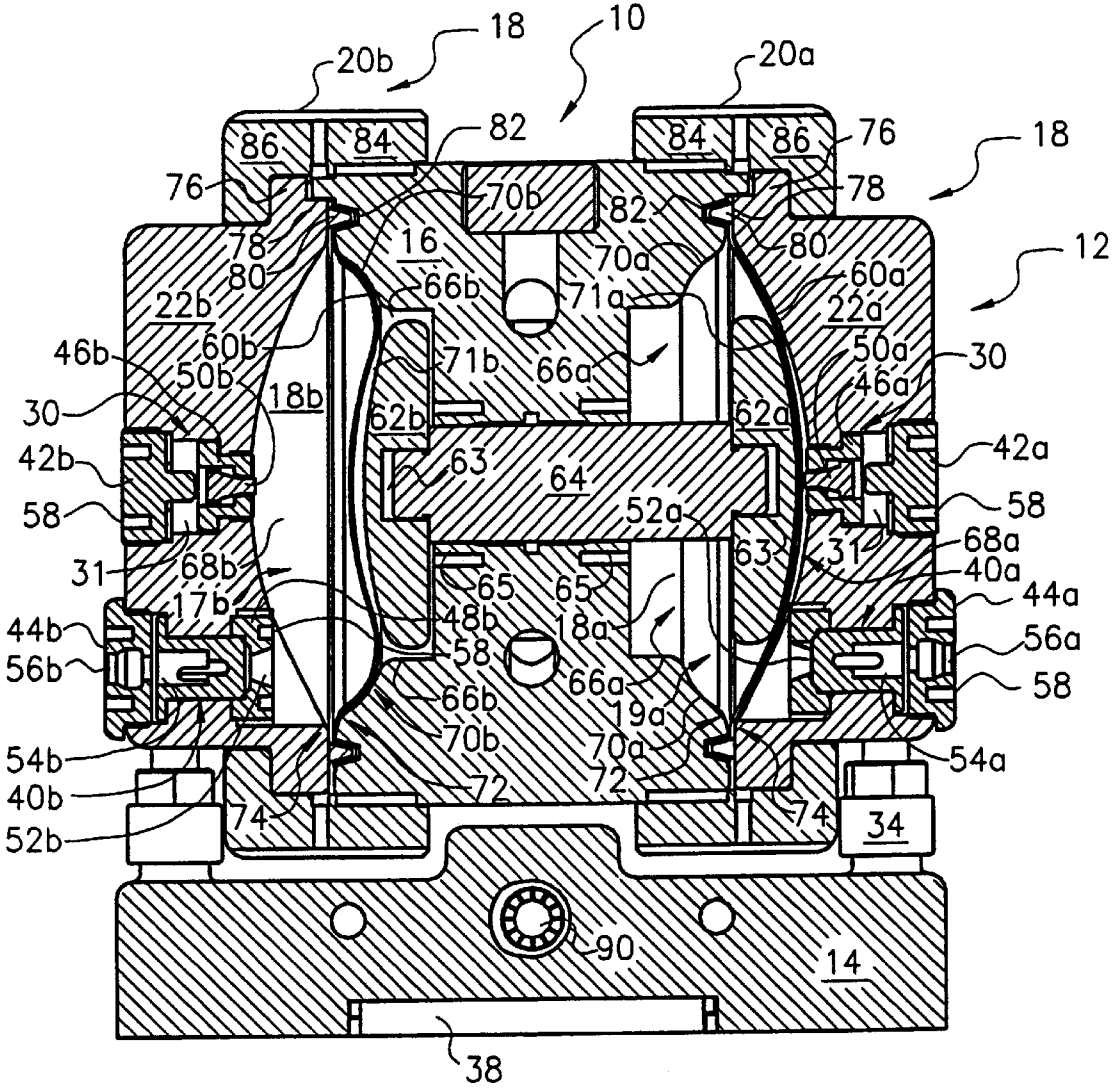
FIG. 4 is a sectioned, side, elevation view of one embodiment of a pump in accordance with the invention.

Referring again to FIG. 1 and also referring generally to FIGS. 2–4, the pump 12, may be manufactured to have slip rings 20 or union rings 20. As a practical matter, alignment of the heads 22 with the frame 16 or body 16 is problematic in many designs of prior art pumps. Various notches, alignment marks, pins, and the like may be used to align the heads 22 with the frame 16 or body 16. However, once aligned, each of the heads 22 may remain aligned with the body 16, uninfluenced by the slip rings 20 as to alignment in a circumferential direction 11*d*.

The slip rings 20 move circumferentially 11*d* with respect to the heads 22. Accordingly, the heads 22 remain fixed with respect to the body 16 in a circumferential direction 11*d*. By contrast, the slip rings 20, in rotating in a circumferential direction 11*d* may thread onto the body 16, drawing the heads 22 longitudinally 11*a* closer in a sealing relationship with the body 16. The slip rings 20 may thus be tightened to any particular loading, particular for heat soaking to relieve primary creep. In one embodiment, the slip rings 20 may be tightened to a design load tolerated by threads associated therewith, in order to seal the heads 22 against the body 16. Thereafter, the pump 12 may be heat soaked in order to accelerate primary creep. Thereafter, the slip rings 20 may be tightened with no circumferential 11*d* displacement of the heads 22. Accordingly, tightening the slip rings 20 against the body 16 at a load and displacement effective to render the apparatus 10 subject only to secondary creep is easily trackable.

Ports 24*a*, 24*b* may form an inlet 24*a*, and outlet 24*b*, respectively. Within the body 16 may be many suitable arrangements of check valves providing biasing of flows through the pump, preventing backflow. Double, serial check valves may provide a rectifier for the fluid flow from the inlet 24*a*, through the chambers 22, to the outlet 24*b*.

In one embodiment, an aperture 26 may be formed in one end of the head 22. A retainer 28 may be provided to thread or otherwise fasten to the aperture 26, securing a pilot 30 or end-of-stroke detector 30. The pilot 30 may be configured to detect the end of a stroke of the pump 12 for operation of a piston near the detector 30 or remote from the detector 30. The pilot 30 may be used to signal the controller 14 in order to switch the direction of an operating fluid driving the pump 12. According to the flows of operating fluids into the pump 12, the transfer fluid being conducted through the inlet 24*a* and outlet 24*b* may be appropriately driven and directed through the pump 12.

In one embodiment, a retainer 32 may fit an aperture 33 in the base 14. The retainer 32 may capture the components of the controller 14 within the base 14. Accordingly, an aperture 33 may be adapted to extend an appropriate distance as needed in order to support the proper valving, porting, control mechanisms, and the like of the controller/base 14.

In one presently preferred embodiment, mounts 34 connecting the base 14 to the pump 12 may actually integrate fittings. Thus, the mounts 34 or line fittings 34 may extend from the base 14 to the pump 12 for conducting fluids thereto. In one presently preferred embodiment, the mounts 34 are the basic lines 34 conducting operating fluid from the controller/base 14 into the heads 22 for driving the pump 16. In one presently preferred embodiment, certain portions of the controller/base 14 may be disposed within a pedestal 36. Moreover, the pedestal 36 may be adapted to fit against the frame 16 or body 16 of the pump 12. Accordingly, the pedestal 36 may assist in the mounts 34 in supporting the pump 12 and restricting the motion thereof.

Referring again to FIG. 2, and continuing to refer generally to FIGS. 1–4, a latch block 38 may be provided for securing the controller/base 14 onto a support surface. The latch block 38 may be configured to engage the base 14 in any of a variety of methods for secure and convenient mounting.

A leak detector 40 may be provided in the heads 22. In one embodiment, a leak detector 40 may also be used as an end-of-stroke detector 30. The pilot 30 or end-of-stroke detector 30 of FIG. 1, in one embodiment, may be a pneumatic and mechanical apparatus. In the embodiment of the detector 40, an optical detection mechanism may be implemented to detect the end of a stroke of the pump 12.

A pilot 30, illustrated in FIG. 2 as a short version for detecting an end of a stroke near the head 22, as opposed to the detector 30 or pilot 30 of FIG. 1, adapted to detect an end of stroke remote from the head and close to the body 16, may be captured by a retainer 42. Similarly, a leak detector 40 may be captured by a retainer 44. The body 46 of the pilot 30 may thus be secured by sealing, wedging, threading, or the like into the head 22. As a practical matter, certain pressurization of materials within the head, may form all sealing surfaces with respect to the body 46. Accordingly, the retainer 42 may apply a force to the body 46, forming a seal and maintaining loads on the seal. In another embodiment, the body 46 may be threaded directly into the head and forming a seal therewith.

A mount 48 for a leak detector 40 may be positioned within the head 22. In one embodiment, the mount 48 may be threadedly engaged into the head 22. By contrast, the actuator 50 of the pilot 30 is free to move longitudinally 11*a* with respect to the pump 12 and head 22.

The mount 48 of the leak detector 40 may be fabricated to include or support a window 52. In one embodiment, the window 52 is adapted to be formed of a material identical to that of the head 22. Accordingly, material compatibilities, creep, sealing, and the like may all be accommodated readily between the materials of the head 22 and mount 48. Meanwhile, the mount 48 can be machined to formed a very thin window 52 adaptable to be translucent or transparent to light. Thus, a reflective beam from and returning to the leak detector 40 may pass through the window 52 into the chamber 18, and back to the leak detector 40 for pickup or reception.

A cavity 54 or slot 54 may be provided within the leak detector 40 in order to accommodate passage of electronic or fiber optic lines. In one embodiment fiber optics are used up to the window 52. Accordingly, the slot 54 may be used to adapt fiber optic lines to fit with their accompanying sheathings through the retainer 44 to the required proximity to the window 52. A channel 56 may be provided through the retainer 44 in order to conduct such lines to a proper control center for interpretation and actuation with respect to any signal detected by the leak detector 40. In one embodiment, profiles may be maintained in a minimum envelope by providing tool holes 58 adapted for rotating circumferentially 11*d* the retainers 42, 44. As a practical matter, substantial force may be developed by application of circumferential 11*d* loads on metal prongs adapted to the tool holes 58. Thus, less material, a cleaner profile, less chance of damage, and the like may be provided by use of the tool holes 58 to operate the retainers 42, 44.

Referring to FIGS. 3–4, and continuing to refer generally to FIGS. 1–2, as well, diaphragms 60 may be disposed within the chambers 18 of the pump 12. The diaphragm 60 may be any isolation medium which is used to separate fluids such as drive fluids from working fluids. In one embodiment, a driver 62, or plate 62 may be thought of as a piston 62 for communicating force or pressure between corresponding diaphragms 60*a*, 60*b*. An aperture 63 may be formed in driver 62 or piston 62 in order to accommodate a shaft 64 operably connecting the drivers 62*a*, 62*b*. The shaft 64 may travel through a barrel 65 formed in the body 16 of the pump 12. The barrel 65 may be received, as illustrated, in order to minimize stress, and permit natural alignment of the drivers 62, shafts 64, and surfaces of the barrel 65 in the frame 16.

A recess 66 may be provided in the body 16 as a cavity 66 for receiving each of the drivers 62. In one embodiment, the recess 66 permits improved support of the diaphragms 60 in operation. More particularly, the recess 66 permits the minimization of any gaps between the body 16 and the driver 62 from leaving unsupported any substantial area of the diaphragm 60. For example a contoured surface 68 formed in the head 22 may support the diaphragm 60 along its entire operational area. Similarly, a contoured surface 70 of the body 16 may be adapted to transition smoothly and snugly from the driver 62. Accordingly, the diaphragm 60*b* positioned against the body 16 and the driver 62*b* may be completely supported even against the dead headed load, a stalled line, or a backflow in a line from which the pump has been shut down. Thus, whether position against the contoured surface 68 of the head 22 or against the contoured surfaces 70 of the body 16 and 71 of the drivers 62, the diaphragm 60 is completely supported.

In one embodiment, as shown in FIG. 3, the driver 62 may be configured with a collection chamber 67 for fluid. The collection chamber 67 accumulates fluids as the driver 62 approaches against the body 16. The driver 62 is further configured with a relief passage 69 for venting the collection chamber 67, thus avoiding pressure buildup. Otherwise pressure buildup may distort components and reduce pump life.

An edge 72 or curvature 72 at an edge of a the body 16 may be smoothly transitioned to reduce or eliminate sources of stress concentrations in the diaphragms 60 in operation. For example, the curves 72 in the body 16, and curves 74 in the heads 22, provide for flexure of the diaphragm 60 in either longitudinal 11*a* without production of stress concentrations and without stretching or folding of the diaphragm 60. In one presently preferred embodiment, all edges or corners of the body 16, driver 62, and head 22 of a pump 12 in accordance with the invention, are adapted to have curvatures 72, 74 and clearances configured together to provide minimization of stress with virtual elimination of strain within the diaphragms 60. Thus, unsupported spans are minimized by appropriate selection on clearance between components, such as between the driver 62 and body 16 with appropriate curvatures further reducing the probability of stress concentrations occurring.

In one presently preferred embodiment, a head 22 may be fabricated to have a cantilever 76. A cantilever, may be thought of as a flange, but does not operate as a flange, as that term is typically used. No through holes are appropriate in one presently preferred embodiment of a cantilever 76. Rather, the cantilever 76 merely forms a plate 76 or skirt 76 extending radially 11*b*, 11*c* away from the chamber 18 formed by the head 22 and body 16. Cantilever 76 is preferably never in contact with the body 16.

Figure 3A:
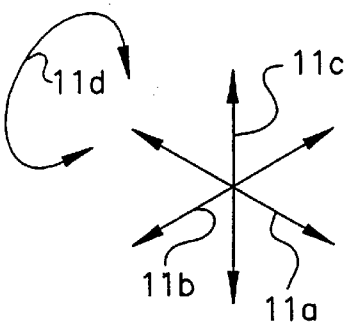
Figure 3A:
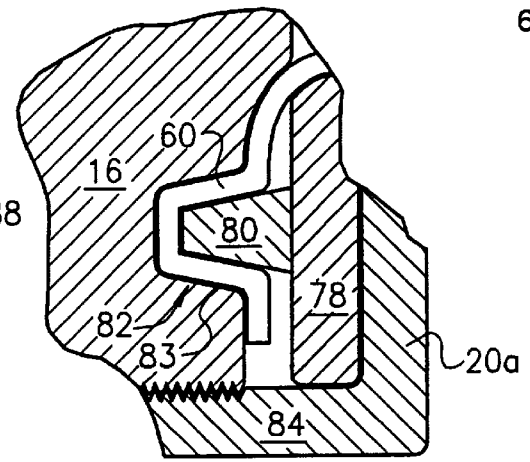
Figure 3A:
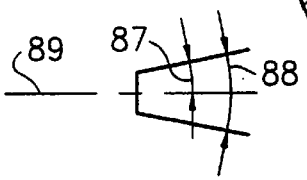

Referring to FIG. 3A, a driver 78 is shown which comprises a wedge 80 which is adaptable to fit into the cavity 82 of the body 16 for gripping and sealing the diaphragm 60 between the driver 78 and the body 16. The driver 78 may be contiguous and integral with the wedge 80. However, in another embodiment, the wedge 80 may be a separate ring having a trapezoidal cross-section. The trapezoid may be regular or irregular. In one presently preferred embodiment, the trapezoidal cross-section of the wedge 80 is exactly symmetrical in order to provide self-centering and equalization of loading. Thus, loading applied by the engagement portion 84 of the slip ring 20*a*, which is transferred from the driver 78 of the head 22 to the wedge 80, may be immediately transferred evenly by the wedge 80 to the diaphragm 60 and to the walls 83 of the cavity 82 in the body 16.

In one presently preferred embodiment, the wedge 80 may be a separate, distinct, and freely movable piece, with respect to radial (the plane of the lateral 1*b* and transverse 11*c* directions) motions. Thus, no binding may occur to interfere with the wedge 80 evenly distributing forces into the cavity 82 of the body 16. In one presently preferred embodiment, an engagement portion 84 of the slip ring 20 or the union nut 20 may threadedly engage the body 16. Accordingly, the turning of the slip ring 20 may draw the head 22, and particularly the cantilever 76 toward the body 16 longitudinally 11*a*. The lip 86 of the slip ring 20 engages the cantilever 76 to drive the cantilever 76 in the longitudinal direction 11*a*. Accordingly, the driver 78, preferably integral to the cantilever 76 and head 22 drives the wedge 80 longitudinally 11*a* into the cavity 82.

Continuing to refer to FIG. 3A and generally to FIGS. 1–4, the wedge 80 may form a half angle 87 of approximately 15 degrees or a full angle 88 of approximately 30 degrees with respect to an axis 89. An axis 89 may be an axis of symmetry 89. However, in one embodiment, the wedge 80 is an irregular trapezoid having only one side tapered with a half-angle 87. However, in one presently preferred embodiment, the wedge 80 has been found to be operationally superior with a symmetric form 88.

Referring to FIG. 3 and generally to FIGS. 1–4, operation of the diaphragms 60 is controlled by a flow of operating fluid, such as air from the controller/base 14 into the chambers 18 toward the heads 22. Accordingly, the chambers 18 pass a transfer fluid being pumped into and out of the chamber 18 between the diaphragms 60 and the body 16. The flow of air in the controller 14 is effected by a shuttle valve 90 or spool valve 90 triggered by the pilot 30.

Sealing the chamber 18 into two portions 17, 19 is effected by the diaphragm 60 in conjunction with the wedge 80. The portion 17 is formed by the diaphragm 60 in the head 22. The portion 19 or chamber 19, is formed by the body 16 and the diaphragm 60. The volume of the respective chambers 17, 19 or portions 17, 19 of the chamber 18 fluctuate. Thus, each 17, 19, in turn, occupies the majority of the chamber 18. The seal is effected by the force applied by the driver 80 of the head 22 against the wedge 80, pinning or capturing the diaphragm 60 between the wedge 80 and the surface 83 of the cavity 82.

The wedge 80 has been found so effective that a calendered fluoropolymer in a fluorocarbon body 16 and head 22 had been found to form a seal that is dramatically integral even after removal of any loading on the wedge 80. Thus, a mechanical, but intimate bond, gas-tight is created between the wedge 80, the diaphragm 60, and the surface 83 of the cavity 82 in the body 16. Due to the presence of the cantilever 76, loading is maintained. Nevertheless, the sealing effect is superior, and requires no metallic, elastomeric, or other reactive components at any location in order maintain the loads and the seals effective to seal the pump 12.

Figure 5:
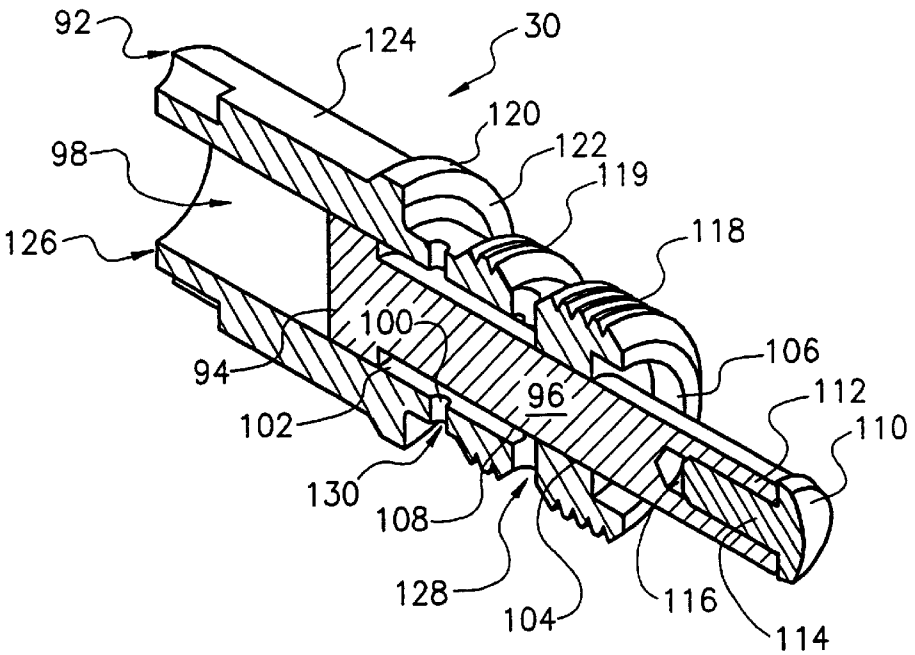
FIG. 5 is a sectioned, perspective view of a long, end-of-stroke, control valve for operation in an apparatus in accordance with the invention.

Referring to FIG. 5, and generally to FIGS. 1–6, a pilot 30 may be formed to have an element 92 adapted to be inserted in a head 22 under a retainer 42. The element 92 may form a body 92 containing a piston 94. The piston 94 may operate similarly to a spool. A shaft 96 may provide both alignment and sealing functions.

In one embodiment, a chamber 98 may be formed in the element 92 for containing a fluid. A vent 100 may be provided between the vented portion 102 or vented chamber 102, that is contiguous with the chamber 98, except for the presence of the piston 94. Thus, the piston 94 and a bearing surface 104 or sealing surface 104 may form the vented chamber 102.

The sealing for the fluid flows is provided by the piston 94 against the element 92, and the shaft 96 against the sealing surface 104. Relief 106, 108 may be provided as appropriate. Thus, manufacturing tolerances may be provided, while binding is eliminated. For example, fastening may tend to warp and bind components.

In one embodiment, the shaft 96 may be provided with a bumper 110 adapted to make contact with a diaphragm 60 against a face 71 of a piston 62. The bumper 110 may be adapted to fit a hollow portion 112 of the shaft 96. A shank 114 may fit into an aperture 116 in the hollow portion 112 of the shaft 96. Accordingly, the bumper 110 may be secured thereby to travel securely with the shaft 96. Thus, the bumper 110 may provide stress distribution, abrasion resistance, and the like so as to minimize any deleterious affect by the shaft 96 on the diaphragm 60. The shafts 96 may thereby follow the diaphragm 60 and piston 62 for detecting the end of the stroke of the piston 62 at the body 16, rather than at the head 22.

Threads 118, 119 may be formed in the element 92 or body 92 of the pilot 30 of FIG. 5. A shoulder 120 may be adapted to stop the element 92 at an appropriate location in the head 22. In one embodiment, a face 122 may abut a corresponding base in the head 22. The wall 124 of the element 92 may be secured within a retainer 42 as illustrated in FIG. 1. A face 126 may be driven or loaded by the retainer 42 thereagainst.

In operation, a passage 128 is formed between the element 92 and the head 22. The passage 128 conducts fluid, as with a spool valve. Likewise, a passage 130 provides communication of the operating fluid (e.g. air) between the chamber 102 and a low-pressure area. Thus, the chamber 98 may be loaded with chamber pressure of the pump 12, until the piston 94 passes a port 100 into the channel 130. Thereupon, the pressure in the chamber 98 may be vented throughout the port 100, indicating that the end of a stroke has been reached.

Figure 6:
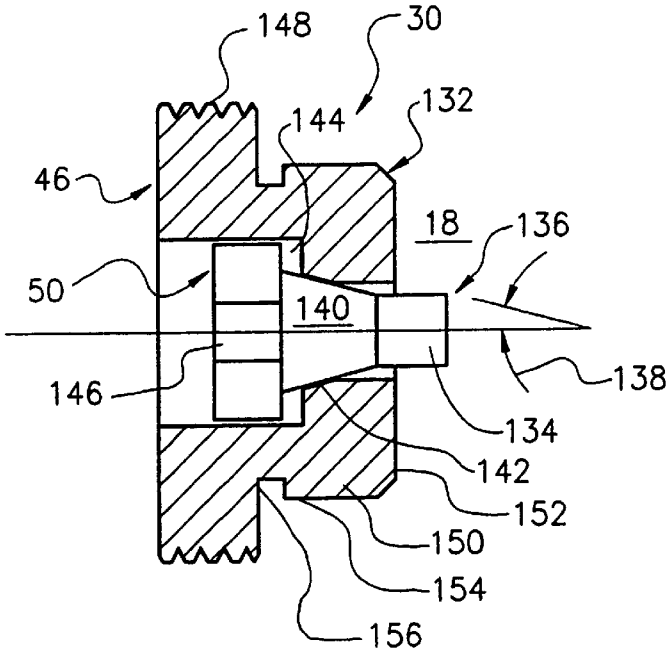
FIG. 6 is a partially sectioned side, elevation view of a valve for use as a pilot or end-of-stroke valve detecting proximity of a diaphragm to the head, in contrast to the valve of FIG. 5 for detecting proximity of the diaphragm to the body of a pump in accordance with the invention.

Referring to FIG. 6, and continuing to refer generally to refer to FIGS. 1–5, an element 132 of a short pilot 30 is illustrated. The pilot 30 may include an actuator 50 provided with a standoff 134 or post 134 extending into the chamber 18 associated with a head 22. The posts 136 and actuator 50 are preferably made from a material, as all materials within the pump 12 and base/controller 14 that are nonreactive, chemically compatible with one another, and non-contaminating, in order to be fail-clean in the event of any failure of the apparatus 10.

The post 134 may be provided with a face 136 adapted to contact a diaphragm 60 when the diaphragm 60 approaches or contacts the surface 68 of a head 22. In one embodiment, the diaphragm 60 may push the face 136 of the post 134 flush with the surface 68 of the head 22. Accordingly, the actuator 50 is freed to move the actual poppet 140 portion or valve portion 140 away from the seat 142, exposing and opening the cavity 144 to pass operating fluid there through. The operating fluid (e.g. air) passes from the chamber 18 through the passage 144 between the poppet 140 and the seat 142, to be discharged through the vents 146 in the sides of the actuator 50.

A threaded portion 148 of a body 46 may secure an insert portion 150 within the head 22. The face 152 may preferably be positioned near the contoured portion 68 of the head 22. In one embodiment, the face 152 may be substantially flush therewith. In any event, the face 136 of the post 134 may protrude sufficiently to permit complete opening of the cavity 144 by movement of the post 134 by the diaphragm 60 and piston 42.

In one embodiment, the body 46 may be provided with a shoulder 154 and relief 156 to assure clean and complete engagement by the head. The shoulder 154 may be straight or tapered with respect to the head. The shoulder 154 will maintain a virtually gas-tight seal with the head 22.

Figure 7:
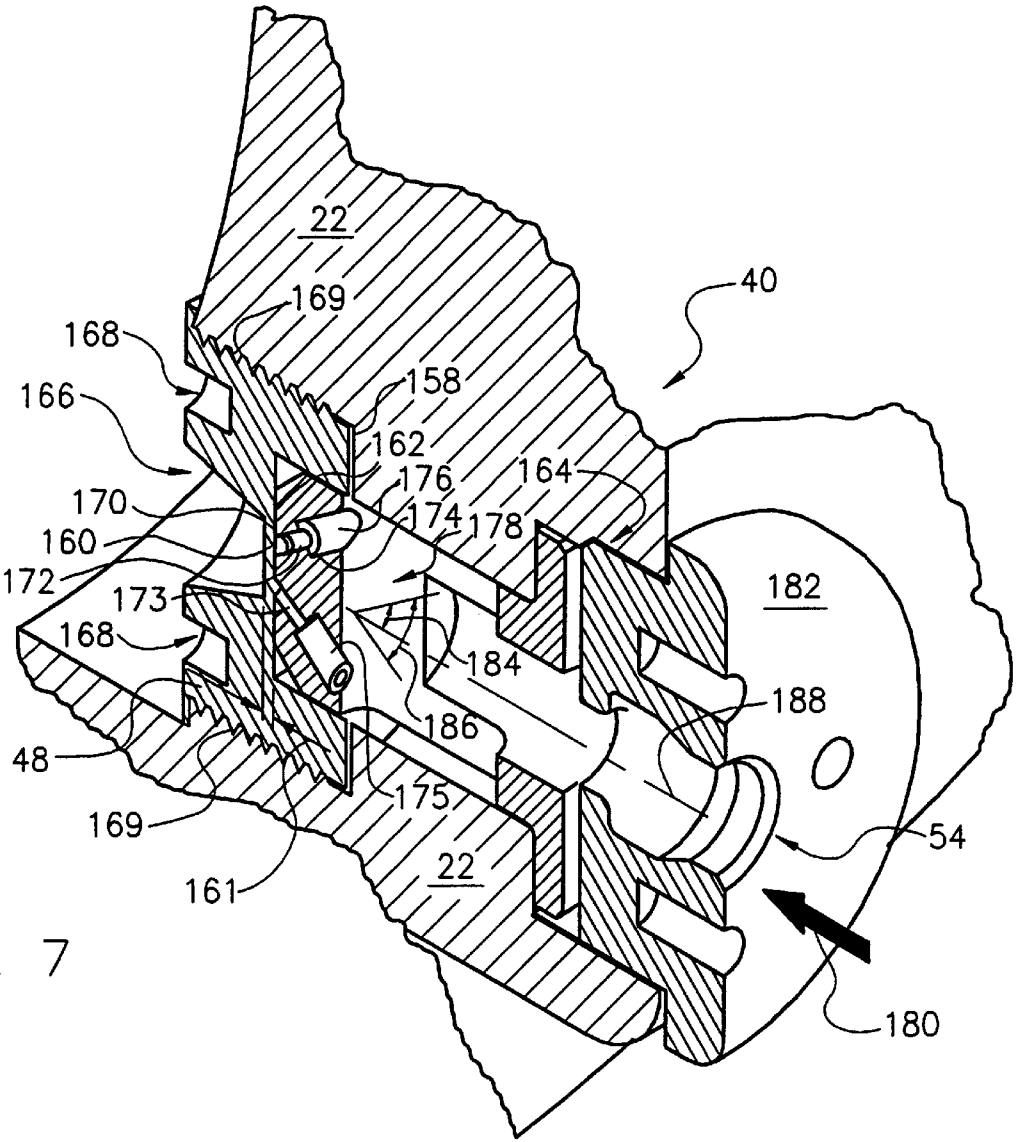
FIG. 7 is a sectioned, perspective view of a leak detection mechanism for implementation in an apparatus in accordance with the invention.

Referring to FIG. 7, a leak detector 40 may be formed to have a channel 54 or cavity 54 adapted to receive fiber optic lines. In one embodiment, a clearance 158 may be provided between the head 22 and the mount 48, assuring intimate access of the leak detector 40 to the window 160. The thickness 161 of the window 160 may be selected to render the window 160 transparent or translucent with respect to the quantity, wave length, and intensity of light required by the leak detector 40. The leak detector 40 is optical in nature. Accordingly, a face 162 may be formed at one end of the body 164 for fitting against the windows 160. A clearance 166 may be provided on an opposite side of the window 160.

In one embodiment, pin tool holes 168 may be provided. Remaining material supports against stresses and distortions in the mount 48. Thus, the apparatus provides for assembly and dimensional stability in the window 166.

A seal clearance 170 may be provided at the front of a passage 172 adapted to receive a fiber 173. The fiber 173 may be glass or polymeric. In one presently preferred embodiment, the fiber 173 may be an acrylic plastic. Glass tends to be particularly brittle and not well adapted to handling. Thus, a clearance 170 may be provided for sealing the passage 172 with a nonreactive material. As a practical matter, the window 160 already provides a seal. Thus, the sealing clearance 170 is optional.

A face 174 or shoulder 174 is provided in one embodiment to restrict and position a sheath 175 surrounding a fiber 173. In one embodiment, a fiber 173 is stripped of a sheath 175 for a distance sufficient to extend through the channel 172. Accordingly, the passage 176 accommodates the entire sheath 175, while the shoulder 174 positions the end of the sheath 175, thereby permitting the fiber optic line 173 to extend toward the window 160.

In one embodiment, a slot 178 may be formed in the leak detector 40. The slot 178 is adapted to receive the sheath 175 and contained line 173 from both the channels 172 (only one is shown). The sheath 175 or leads 175 may then traverse from the slot 178 to be gathered into a channel 54 passing out of the leak detector 40. The slot 178 has a primary effect of permitting the channels 172 to be positioned at a half angle 184 or full angle 186 of a center line 188. Thus, the slot 178 provides adequate room for the turning required by the sheath 175 without damage to the fibers 173 or lines 173 of fiber optic material. Accordingly, the sheath 175 may then be routed throughout the channel 54, exiting the leak detector 40.

In one embodiment, a load 180 may be applied by a retainer 44 engaging the head 22. The load 180 may be applied directly by the head 182 of the leak detector 40. Thus, end of a contact may be maintained between the face 162 and the mount 48 and particularly the window 160.

In operation one of the lines 173 may conduct a light beam to the window 160. The light may be directed by the change in the index of refraction between the material in the line 173, the window 160, and air in the clearance 166 or the cavity 17 (chamber 17 of the chamber 18). Thus, light directed from a line 173 is reflected back to the receiving fiber, in the presence of air. In the presence of a liquid, however, such as may occur during a leak caused by diaphragm or seal failure, the clearance 166 may become filled with a liquid. Accordingly, the index of refraction for light passing from the line 173 through the window 160, and into the liquid 160 may be used to determine the angle 186 between the channels 172 and the lines 173. The presence of liquid in the clearance 166 disburses the incoming light, thereby changing the index of refraction of the light reflected through clearance 166, which is detected by the leak detector 40. Thus, the leak detector 40 detects any change in the index of refraction which may be caused by a liquid or a gas leaking into the clearance 166. In one embodiment, the window 160 may be positioned near to the diaphragm 60. In such an embodiment, a reflection of light from the diaphragm proximate the window 160 may be detected by a line 173 receiving from a corresponding line 173 eliminating the diaphragm 60.

The leak detector 40 may operate as an end-of-stroke detector 30. However, the optical signals from the lines 173 must be converted into some kind of mechanical actuation to control the flow of air or other motive fluid or driving fluid into the chamber 17 for driving the diaphragm 60.

Figure 8:
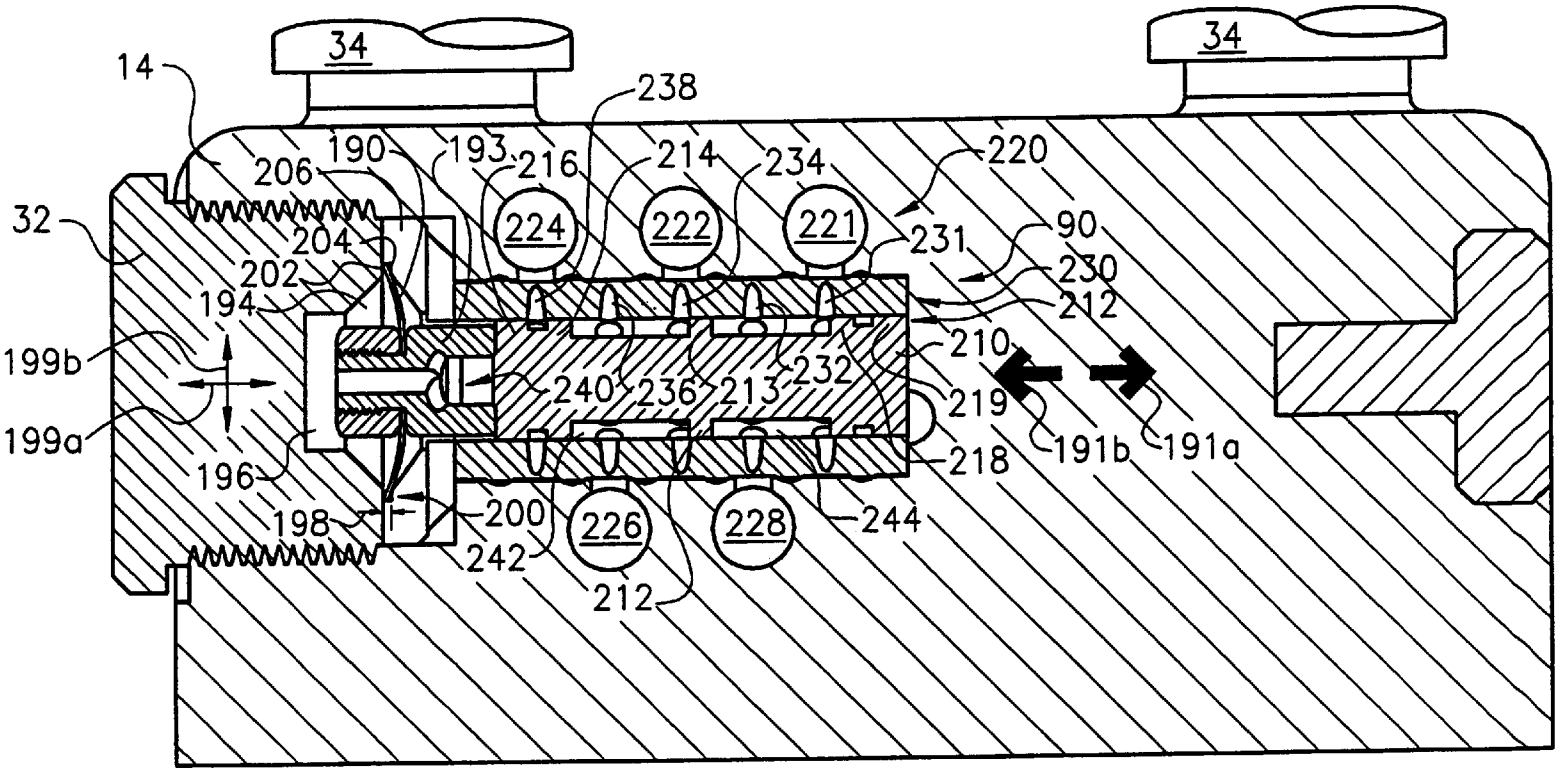
FIG. 8 a sectioned side elevation view (end with respect to the pump) of a spool valve for the air control in the base of an apparatus in accordance with the invention.

Referring to FIG. 8, a spool valve 90 may be provided with a bias 190 or a bias element 190 for rendering a digital response from the spool valve 90 or shuttle valve 90. In one embodiment, a bias force 191 is provided by the bias element 190 depending on the orientation thereof. The bias 190 is captured by a head 192 or nut 192 secured to a shaft 193, capturing the bias 192 flexibly therebetween.

A chamber 194 adapted for ready movement by the bias 190 is provided by the retainer 32 and a fitting 206. The chamber 194 permits free motion of the bias 190 in a longitudinal direction with respect to the shuttle valve 90. A chamber 196 is formed for receiving the head 192 of the shuttle 90. In one embodiment, a thickness 198 of a gap 200 formed to receive a bias 190 between the retainer 32 and fitting 206 may be critical. Forming a flange in place of the bias 190 provides residual stresses and restraints on deflection thereof.

Clearance is made to accommodate positioning of the bias 190 against a far corner 202 or a near corner 204, with respect to the spool valve 90 or shuttle valve 90. Thus, the bias 190 may be constrained in a radial direction 199*b,* while being completely free in an axial direction 199*a,* so long as the bias force 191 has been overcome. Thus, the bias 190 operates like the bottom of a traditional oil can.

Nevertheless, the constraint in a radial direction 199*b* by the fitting 206 in no way restricts the positioning of the bias 190 in either corner 202, 204. Thus, the bias 190 is free to flip in an axial direction 199*a* upon achievement of sufficient bias force 191. Thus, the bias 190 renders the shuttle 90 a digital valve rather than a proportional valve. Proportional valving has been found to be unreliable, and not sufficiently precise for reliable operation of the pump 12.

By contrast, the bias 190 by being formed of a stiff, comparatively rigid, yet flexible, nonreactive, fail-clean material, such as a chlorofluorocarbon formed in a comparatively strong, stiff sheet, has been found to be effective to provide a digital operation of the spool valve 90 within a narrowly designed range of bias floats 191. The proper provision of a cap 198 that does not constrain the motion of the bias 190 and head 192 in an axial direction 199*a* has been found to be effective to provide such a digital positioning function.

Otherwise, the spool 210 of the spool valve 90 may otherwise operate as understood in the art. The seals 212, generally, and specifically each of the seals 213, 214, 216, 218, 219 operate to direct fluid into a variety of conduits 220 or channels 220. The channels 220 and specifically the channels 221, 222, 224, 226, 228 direct working fluid the operating fluid controlling the movement of the diaphragm in the head 22 of the pump 12 as heretofore described. Porting the working fluid (e.g. air) to the proper diaphragm 60, or chamber 17, in order to drive a diaphragm 60, may be accommodated by the respective channel 220, in response to a seal 212 directing the operating fluid from one port 230 to another 230. Specifically, each of the ports 231, 232, 234, 236, 238 is opened, closed, and transferred between the respective channels 240, 242, 244 as a seal 212 is passed thereover or thereby longitudinally 199*a.*

A driving fluid may be passed in through a channel 240, and onto one of the channels 220. A channel 220 connected to a port 230 may then transfer fluid into a channel 242, 244 selected according to the longitudinal 199*a* position of the spool 210. Thus, a particular seal 212 may direct communication of fluid from one port 230 to another 230 by way of one of the channels 242, 244 extending circumferentially about the spool 210.

In one embodiment, the spool 210 may be formed of a ceramic material. Accordingly, no elastomeric seals are formed anywhere in the apparatus 10. Rather, each of the materials from which the spool 210, head 192, bias 190, fitting 206, retainer 32, and base 14 are formed may be selected from nonreactive, durable non-contaminating, fail-clean materials such as chlorofluorocarbons.

Figure 9:
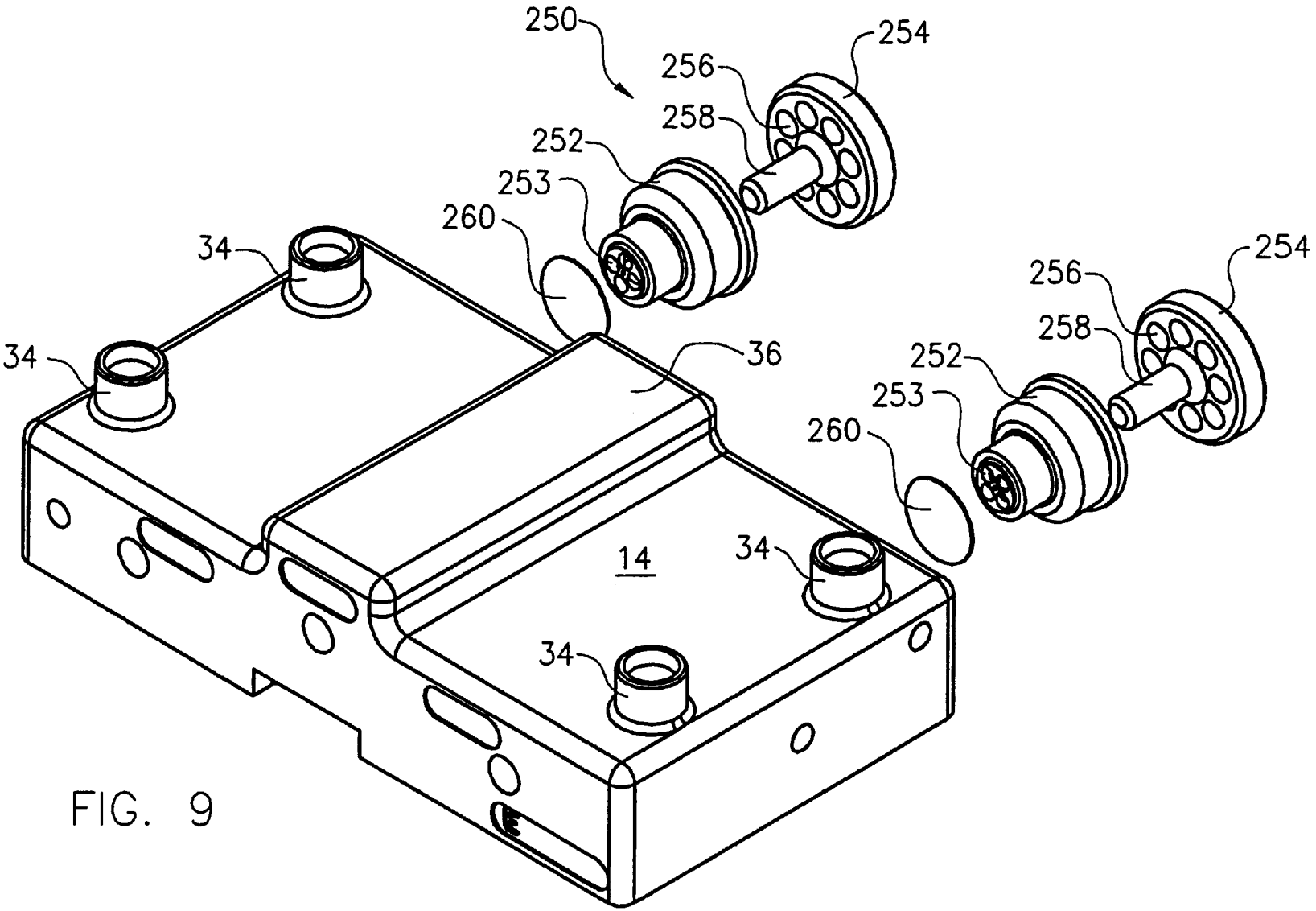
FIG. 9 is a perspective view, partially-exploded, of a base for implementation with an apparatus in accordance with the invention.
Figure 10:
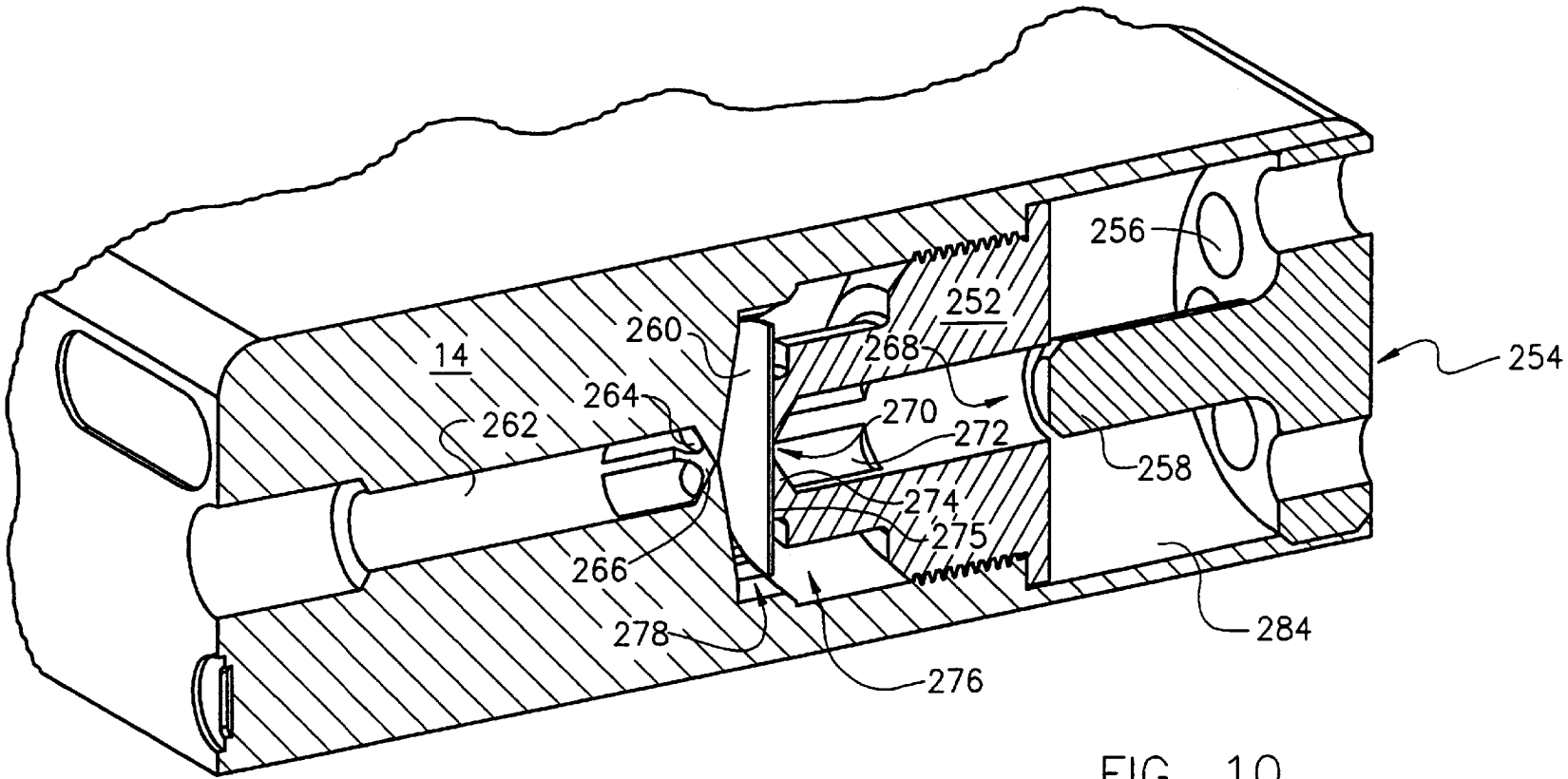
FIGS. 10–11 are a perspective and elevation, respectively, sectioned views, of a quick-release, high-volume, air-exhaust valve for use with an externally controlled air supply for an apparatus in accordance with the invention.
Figure 11:
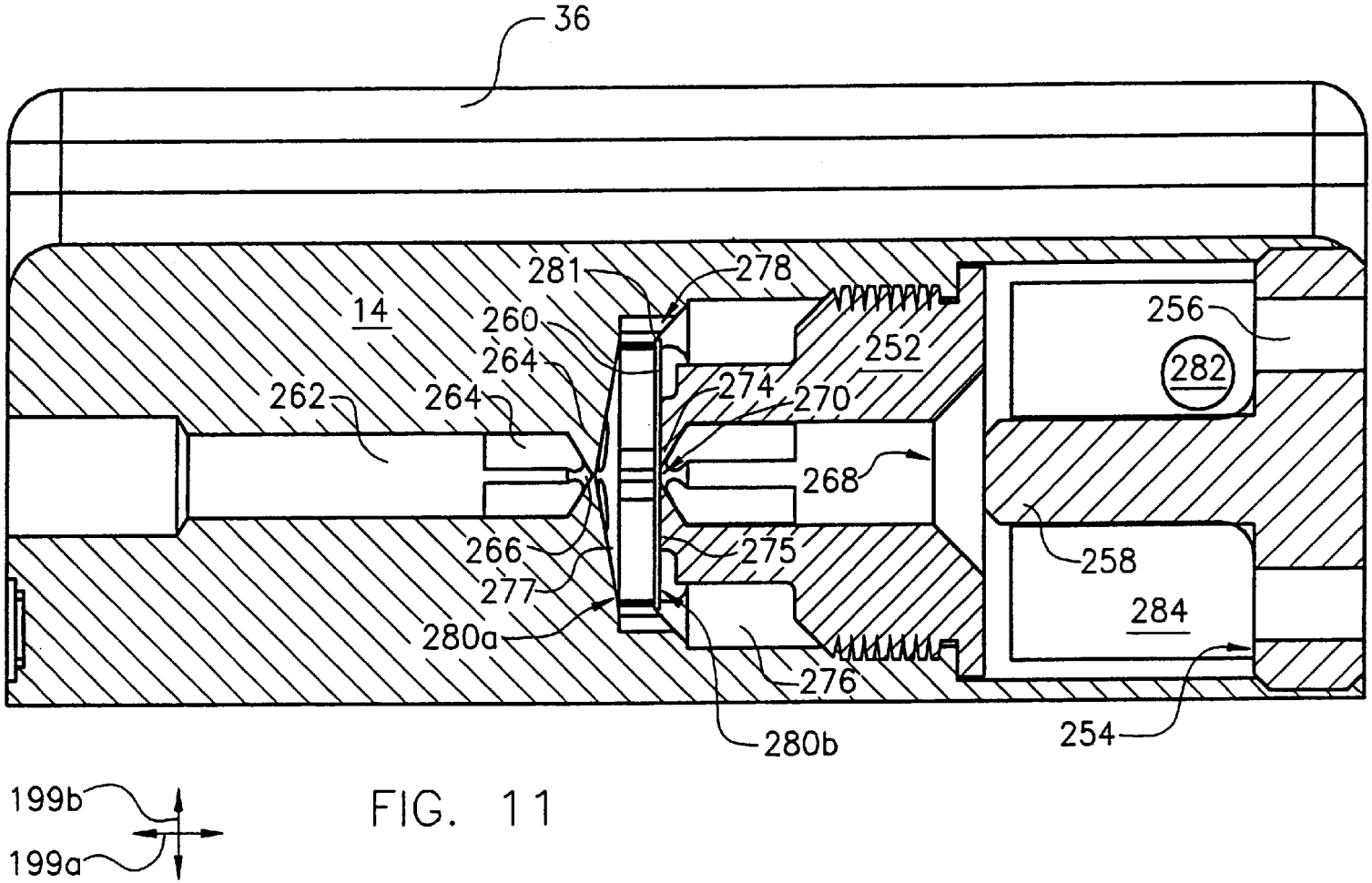

Referring to FIGS. 9–11, a dump valve 250 or fast-relief, exhaust valve 250 may be formed to operate in the base 14 of an apparatus 10 in accordance with the invention. In one embodiment, an insert 252 may be adapted with a muffler 254 to fit into the base 14. The muffler 254 may be provided with multiple ports 256 for dumping large amounts of operating fluid (e.g. air) from a non-recirculating, external driver or controller, after discharge thereof, from the chamber 17 of the pump 12. The post 258 may serve to actuate and align operation of the valve 253.

A disk 260 provides a principal seal 260 for the valve 250. For example, operative fluid may be provided to or from the spool cavity 262. Ports 264 and a support post 266 or cross 266 may be formed to pass operating fluid from the cavity 262, while supporting the structural mechanics of the base 14 and the operation of the disk 260. A channel 268 may similarly be disposed throughout the interior of the insert 252. The channel 268 may communicate through a port 270 in the insert 252.

The port 270 may form an aperture having a flat face 275 adapted to support the disk 260 therein. When the disk 260 is forced by a flow against the disk 260 to contact the flat face 275 the aperture 270 may be effectively closed by the disk 260. The cross 274 supports the flat face 275, providing ports 270 there through while supporting the disk 260 against failure in an axial direction 199*a.*

A channel 276 conducts working fluid away from the disk 260, by passing the fluid from the channel 262, through the ports 264 drilled eccentrically with respect to the channel 262, and accessing a cavity 277 on one side 280*a* of the disk 260. Clearances 278 provide passage for fluid around the perimeter 281 of the disk 260. Accordingly, area in one direction may pass freely around the disk 260, accessing the chamber 276 by way of the clearance 278, which may be fluted to position the disks 260 effectively while still providing passage of fluid. Thus, fluid may pass through a suitable porting mechanism to the port 282 into a chamber 284, for discharge throughout the ports 256 throughout the muffler 254. By contrast, the disk 260 may also be biased to seal against the flat faced 275, closing the ports 270 against passage of loads.

The present invention may be embodied in other specific forms without departing from its structures, methods, or other essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed is:

1. A fiber optic system for detecting the stroke of a pump having a diaphragm that is driven into and out of a sealed chamber of the pump, the fiber optic system comprising:

a first fiber optic line configured for directing light into the sealed chamber of the pump; and a second fiber optic line configured for receiving light, wherein said first and second fiber optic lines are disposed at an angle calculated to reflect light off of the diaphragm when the diaphragm is located at a predetermined distance from the fiber optic system.

2. A fiber optic system as defined in claim 1, further comprising a body configured for removably mounting onto the pump proximate the sealed chamber, and wherein said first and second fiber optic lines are disposed within said body.

3. A fiber optic system as defined in claim 1, wherein said first and second fiber optic lines comprise acrylic fiber.

4. A fiber optic system as defined in claim 1, wherein said fiber optic system generates a digital signal when light is received by the second fiber optic line.

5. A fiber optic system as defined in claim 4, wherein the digital signal is used to control the movement of the diaphragm.

6. A seal system for sealing a first chamber from a second chamber of a pump having a head and a frame and which is configured for pumping ultra-pure fluids, the seal system comprising:

a receiving surface, the receiving surface defining the boundaries of a perimeter cavity formed in the frame;

a diaphragm disposed between the head and the frame;

a wedge configured to be inserted into the cavity of the frame; and a driver integrally connected to the head, wherein said driver is configured to drive the wedge into the perimeter cavity and thereby seal the diaphragm between the first chamber and the second chamber at the perimeter cavity with an airtight seal.

7. A seal system as defined in claim 6, wherein said wedge is self-centering within the cavity of the frame.

8. A seal system as defined in claim 6, wherein said diaphragm is composed of a material composition comprising at least one of a polymeric material, flouropolymer and polytetraflouretheyne.

9. A seal system as defined in claim 6, further comprising a slip ring configured for applying a force to the head, wherein said force causes the driver to drive the wedge into the cavity of the frame.

10. A seal system as defined in claim 9, wherein the slip ring threadedly engages the frame.

11. A seal system as defined in claim 6, wherein the wedge and the cavity each comprise a trapezoidal shape.

12. A seal system as defined in claim 11, wherein the trapezoidal shape comprises a regular and symmetric trapezoidal shape having two tapered sides.

13. A seal system as defined in claim 11, wherein the trapezoidal shape comprises an irregular and asymmetrical trapezoidal shape having only a single tapered side.

14. A seal system as defined in claim 11, wherein said wedge is integrally connected to the driver.

15. A seal system as defined in claim 11, wherein said wedge comprises a ring that is independent from the driver.

16. A fiber optic system for detecting a leak of a liquid into a sealed chamber of a pump comprising:

a first fiber optic line configured for directing light into the sealed chamber of the pump; and a second fiber optic line configured for receiving light, wherein said first and second fiber optic lines are disposed at an angle calculated to reflect light directed from the first fiber optic line to the second fiber optic line only in the presence of a liquid comprising a predetermined index of refraction, and wherein said liquid only enters the sealed chamber when there is a leak.

17. A fiber optic system as defined in claim 16, wherein the sealed chamber comprises an air chamber filled with air.

18. A fiber optic system as defined in claim 16, wherein said liquid comprises at least one of a hot, pure, and reactive liquid.

19. A fiber optic system as defined in claim 16, wherein said fiber optic system generates a digital signal when light is received by the second fiber optic line.

20. A fiber optic system as defined in claim 16, further comprising a body configured for removably mounting onto the pump proximate the sealed chamber, and wherein said first and second fiber optic lines are disposed within said body.

21. A fiber optic system as defined in claim 20, further comprising a window disposed between the body and the sealed chamber.

22. A fiber optic system as defined in claim 21, wherein the window seals said first and second fiber optic lines from the sealed chamber.

23. A fiber optic system as defined in claim 22, wherein said first and second fiber optic lines comprise acrylic fiber.

24. A fiber optic system as defined in claim 21, wherein the window comprises a transparent window through which light directed out of the first fiber optic line can pass.

* * * * *